United States Patent [19]

Horiuchi et al.

[11] 4,216,014

[45] Aug. 5, 1980

[54] LOW TEMPERATURE STEEL ALLOY

[75] Inventors: Kaoru Horiuchi, Toride; Akio Matsui, Chiba; Masahiro Hara, Sakura; Hiroshi Takahashi, Funabashi, all of Japan

[73] Assignee: Kawasaki Jukogyo Kabushiki Kaisha, Hyogo, Japan

[21] Appl. No.: 957,809

[22] Filed: Nov. 6, 1978

[30] Foreign Application Priority Data

Nov. 22, 1977 [JP] Japan ..... 52-141018

[51] Int. Cl.[2] ..... C22C 39/20

[52] U.S. Cl. ..... 75/128 C; 75/128 W

[58] Field of Search ..... 148/36; 75/128 C, 128 W

[56] References Cited

U.S. PATENT DOCUMENTS

| | | | |
|---|---|---|---|
| 1,987,841 | 1/1935 | Ritterhausen | 75/128 W |
| 2,031,904 | 2/1936 | Ritterhausen et al. | 75/128 W |
| 2,059,746 | 11/1936 | Ritterhausen | 75/128 W |
| 2,327,490 | 8/1943 | Bagsar | 75/128 W |
| 3,027,253 | 3/1962 | Yeo | 75/128 W |
| 3,574,602 | 4/1971 | Gondo et al. | 75/128 C |

FOREIGN PATENT DOCUMENTS

| | | | |
|---|---|---|---|
| 70661 | 1/1942 | Czechoslovakia | 75/128 W |
| 73222 | 9/1944 | Czechoslovakia | 75/128 W |
| 80701 | 7/1951 | Czechoslovakia | 75/128 W |
| 148129 | 2/1936 | Fed. Rep. of Germany | 75/128 W |
| 897766 | 8/1945 | France | 75/128 W |

*Primary Examiner*—M. J. Andrews

*Attorney, Agent, or Firm*—Lane, Aitken & Ziems

[57] ABSTRACT

Low temperature steel alloys having a high toughness and hardness, consisting essentially of from 0.20 to 0.30 wt % of carbon, from 1.20 to 2.00 wt % of silicon, from 0.30 to 0.80 wt % of manganese, from 1.70 to 2.40 wt % of nickel, from 2.50 to 3.50 wt % of chromium, from 0.30 to 0.55 wt % of molybdenum, and the balance essentially iron.

1 Claim, 1 Drawing Figure

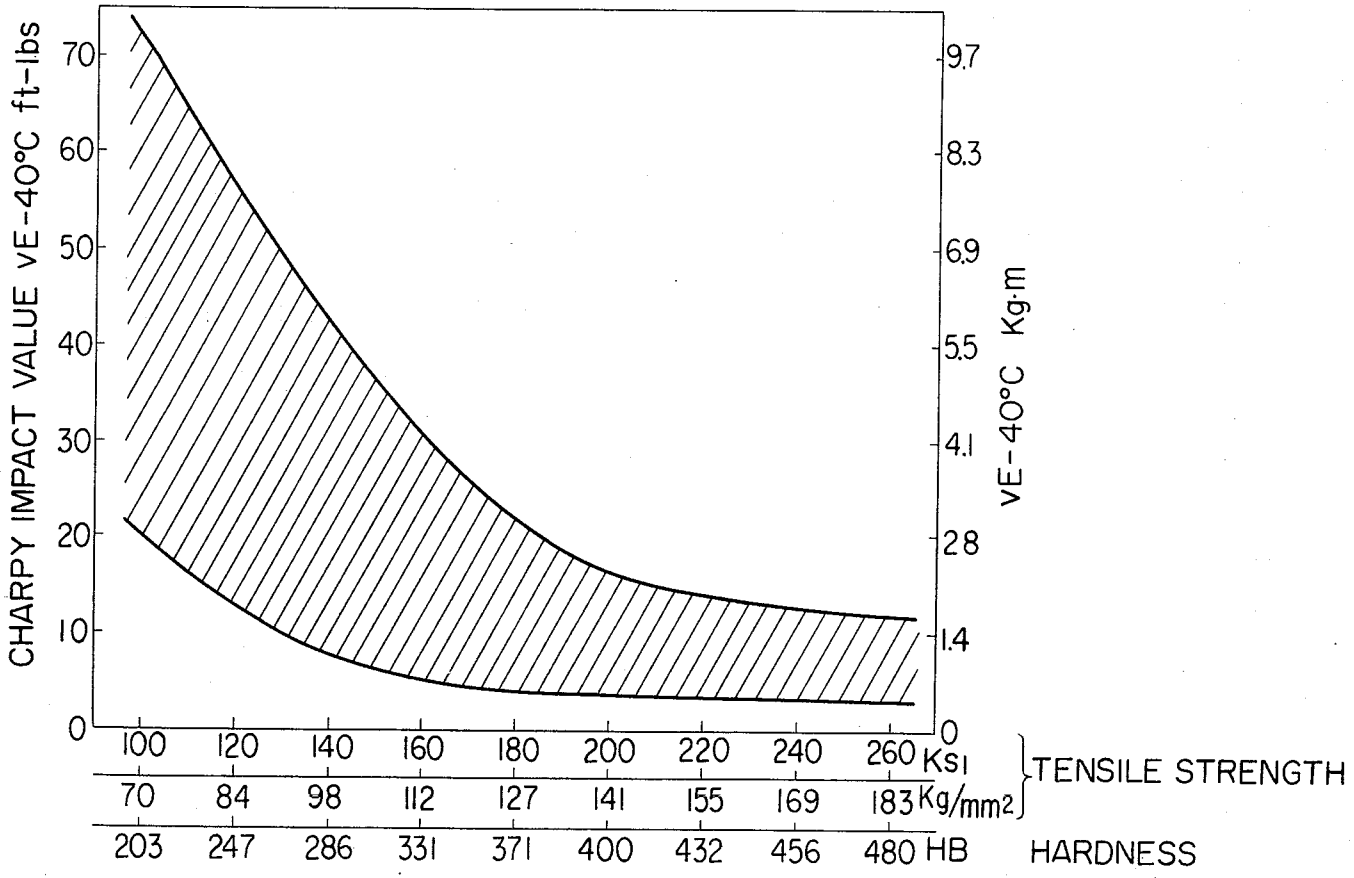
CHARPY IMPACT VALUE VE-40°C ft-lbs
70
60
50
40
30
20
10
0
9.7
8.3
6.9
5.5
4.1
2.8
1.4
0
VE-40°C Kg·m
100 120 140 160 180 200 220 240 260 Ksi
70 84 98 112 127 141 155 169 183 Kg/mm2
TENSILE STRENGTH
203 247 286 331 371 400 432 456 480 HB
HARDNESS

LOW TEMPERATURE STEEL ALLOY

BACKGROUND OF THE INVENTION

This invention relates generally to a novel low temperature steel alloy and more particularly to a steel alloy capable of affording a hardness of about HB 450–500 and a V-notch Charpy impact value at −40° C. of at least about 15 ft-lbs.

When construction machines such as power shovels, wheel excavators and the like are used in extremely cold regions such as Alaska and polar regions, it is essential that parts thereof subjected to wearing and impact conditions be made of a material having improved low temperature mechanical properties.

Wear-resistant cast steels have been generally employed for such parts, which steels are obtained by the heat treatment, including hardening and tempering, of low alloy cast steels so as to impart a hardness (Brinell) of HB 400–500. Low temperature mechanical properties of the conventional cast steels, however, are not satisfactory. FIG. 1 shows the relationship between tensile strength and hardness, and Charpy impact value at −40° C. in conventional heat treated low alloy cast steels, from which it will be seen that their low temperature impact value decreases with increase in their hardness. Thus, the conventional cast steels having a sufficient hardness fail to show desirable toughness, involving a danger of brittle fracture, whereas those having a sufficient low temperature impact value fail to exhibit a satisfactory hardness, and are poor in wearing resistance.

SUMMARY OF THE INVENTION

It is, accordingly, an object of the present invention to provide a low temperature steel alloy which is devoid of the drawback involved in the conventional steels.

Another object of the present invention is to provide a steel alloy capable of affording both improved hardness and toughness even at low temperatures.

It is a special object of the present invention to provide a steel alloy having a hardness of about HB 450–500 and a V-notch Charpy impact value at −40° C. of at least about 15 ft.-lbs.

In accomplishing the foregoing objects, the present invention provides an improved low temperature steel alloy having a high toughness and a wear-resistance, consisting essentially of from 0.20 to 0.30 wt % of carbon; from 1.20 to 2.00 wt % of silicon; from 0.30 to 0.80 wt % of manganese; from 1.70 to 2.40 wt % of nickel; from 2.50 to 3.50 wt % of chromium; from 0.30 to 0.55 wt % of molybdenum; and the balance essentially iron.

Other objects, features and advantages of this invention will become apparent from the detailed description of the preferred embodiment which follows.

BRIEF DESCRIPTION OF THE DRAWING

The sole FIGURE is a curve band showing the relationship between hardness and Charpy impact value at −40° C. of conventional low alloy cast steels.

DETAILED DESCRIPTION OF THE PREFERRED EMBODIMENTS OF THE INVENTION

The steel alloys of this invention should contain from 0.20 to 0.30 wt % of carbon. An amount of carbon below 0.20 wt % is insufficient to impart a desirable degree of hardness to the steel. Above 0.30 wt % carbon, the toughness becomes unsatisfactory.

Silicon functions as a deoxidation agent and a solid solution hardening agent, and further serves to shift low-temperature temper brittleness to the high temperature side and to reduce segregation of carbon in a casting structure. In order to obtain a fair degree of such effects, it is necessary that the silicon be present in the novel steel alloys in an amount at least 1.20 wt %. Above 2.00 wt % silicon, however, the steel becomes poor in both hardness and toughness. Thus, the silicon is present in the novel steel alloys in amounts ranging from 1.20 to 2.00 wt %.

The manganese concentration in the steel alloys of this invention varies from 0.30 to 0.80 wt %. Manganese, likewise silicon, functions as a deoxidation agent and serves to improve the hardenability of the steels. Further, it is effective in suppressing an adverse effect by sulfur in toughness. At least 0.30 wt % manganese is required to obtain these effects. Above 0.80 wt % manganese, there is a danger of cracking of the steel during or after heat treatments.

The nickel concentration in the steel alloys of this invention varies from 1.70 to 2.40 wt % in order to improve hardenability and toughness of the steel. At least 1.70 wt % nickel is required to impart these properties to the steel, while amounts above 2.40 wt % of nickel increase retained austenite and decrease toughness of the steel.

Chromium is added to steel in order to increase its hardenability and anti-temperability. Amounts of chromium ranging from 2.50 to 3.50 wt % give satisfactory results in toughness and hardness of the steel of this invention. An amount of chromium below 2.50 wt % is insufficient to impart a desirable hardness to the steel, while above 3.50 wt % there is caused excess precipitation of carbides, resulting in lowering of toughness.

The molybdenum concentration in the steel alloys of this invention is required to be at least 0.30 wt % in order to improve hardenability and to prevent temper brittleness. No additional benefit is obtained from amounts of molybdenum above 0.55 wt %. Thus, the molybdenum concentration ranges from 0.30 to 0.55 wt %.

A heat of steel of this invention having the above elements in specified amounts is air melted, refined and cast in a conventional manner. In the melting and refining steps, it is desirable to minimize occurrence of impurities, non-metal inclusions, etc. Thus it is suited that these steps be carried out while adding a deoxidation agent and/or a desulphurization agent such as aluminum, calcium-silicon, titanium in suitable amounts. The cast metal is then subjected to heat treatments to impart thereto desirable mechanical properties. The heat treatments include annealing or normalizing at a temperature at least its $Ac_3$ point, followed by hardening and tempering to obtain tempered martensite structures.

The hardening is conducted by heating to 950° to 1050° C. for a period of about one hour per one inch of the metal. Subsequently, the metal is rapidly cooled in water or an oil. This is followed by tempering at a temperature of from 150 to 300° C. for a period of from 1 to 2 hours, thereby to obtain a steel alloy having a desired wear and low temperature impact resistance.

The following tables further illustrate the present invention.

Table I

| Example No. | | Composition (Wt %) C | Si | Mn | Ni | Cr | Mo | |
|---|---|---|---|---|---|---|---|---|
| Inventive Steel | 1 | 0.26 | 1.60 | 0.40 | 2.13 | 3.34 | 0.30 | |
| | 2 | 0.24 | 1.70 | 0.59 | 2.12 | 3.24 | 0.31 | |
| | 3 | 0.21 | 1.35 | 0.76 | 2.28 | 2.95 | 0.25 | |
| | 4 | 0.30 | 1.87 | 0.37 | 1.94 | 2.92 | 0.48 | |
| | 5 | 0.24 | 1.23 | 0.79 | 1.89 | 3.43 | 0.42 | |
| | 6 | 0.23 | 1.47 | 0.32 | 2.36 | 2.58 | 0.52 | |
| | 7 | 0.28 | 1.98 | 0.30 | 2.39 | 3.47 | 0.54 | |
| | 8 | 0.22 | 1.22 | 0.76 | 2.09 | 2.60 | 0.47 | |
| Conventional Steel | 9 | 0.40 | 1.60 | 0.75 | 1.85 | 0.85 | 0.40 | V 0.08 |
| | 10 | 0.42 | — | 1.15 | — | 0.30 | 0.35 | |
| | 11 | 0.60 | — | 0.70 | — | 2.15 | 0.40 | |
| | 12 | 0.30 | — | 1.15 | — | 1.10 | 0.40 | V 0.09 |
| | 13 | 0.30 | — | 1.20 | — | — | 0.25 | V 0.05 |

Table II

| Example No. | Condition of Heat Treatments: Hardening Temp. and Time; cooling medium | | Tempering Temp. and Time | |
|---|---|---|---|---|
| 1 | 1000° C. in water | 1.5 H | 200° C. | 1.5 H |
| 2 | 950° C. in oil | 1.5 H | 200° C. | 1.5 H |
| 3 | 1050° C. in water | 1.5 H | 170° C. | 1.5 H |
| 4 | 1000° C. in oil | 1.5 H | 250° C. | 1.5 H |
| 5 | 950° C. in water | 1.5 H | 200° C. | 1.5 H |
| 6 | 1000° C. in water | 1.5 H | 180° C. | 1.5 H |
| 7 | 1050° C. in oil | 1.5 H | 250° C. | 1.5 H |
| 8 | 1000° C. in water | 1.5 H | 220° C. | 1.5 H |

Table III

| Example No. | | Mechanical Properties: 0.2% Yield Point(Kg/mm$^2$) | Tensile Strength (Kg/mm$^2$) | Elongation (%) | Reduction of Area (%) | Hardness (HB) | Charpy Impact Value at −40° C. (ft - lbs) |
|---|---|---|---|---|---|---|---|
| Inventive Steel | 1 | 143 | 174 | 8.0 | 28.4 | 475 | 17.2 |
| | 2 | 141 | 172 | 7.5 | 24.5 | 470 | 17.0 |
| | 3 | 137 | 169 | 8.5 | 29.4 | 468 | 18.4 |
| | 4 | 153 | 182 | 6.4 | 21.6 | 488 | 15.8 |
| | 5 | 146 | 172 | 7.1 | 23.4 | 477 | 16.2 |
| | 6 | 139 | 169 | 7.3 | 25.4 | 465 | 17.4 |
| | 7 | 150 | 178 | 6.6 | 23.3 | 495 | 15.8 |
| | 8 | 138 | 171 | 8.2 | 25.1 | 469 | 17.9 |
| Conventional Steel | 9 | 153 | 183 | 5 | 11 | 528 | 9 |
| | 10 | 161 | 184 | 5.5 | 8.5 | 550 | 10 |
| | 11 | 130 | 143 | 2.5 | 3.9 | 437 | 3 |
| | 12 | 137 | 175 | 5.5 | 8.3 | 495 | 10 |
| | 13 | 112 | 134 | 8 | 12 | 440 | 10 |

In Table I, the balance of the composition in each example is substantially iron. Table II shows conditions of heat treatments for the steel alloys of this invention and Table III shows various mechanical properties thereof together with those of conventional steels taken from Steel Casting Handbook (published by STEEL FOUNDER'S SOCIETY OF AMERICA) 4th Edition for comparison purposes.

From the data in Table III, it is apparent that the steel alloys of this invention have an excellent low temperature toughness as well as a high hardness, strength and ductility. In comparison with the conventional steels, the inventive steel alloys have comparable wear resistance and far superior low temperature impact resistance.

Additionally, the following merits can be achieved by the present invention. Insufficient deoxidation during melting and steel making steps is prevented due to the relatively high silicon concentration. Cast steels having complicated structures can be produced due to a feasible good fluidity. The undesirable mass effect often observed when producing articles having a large thickness can be minimized due to a good hardenability, which means producibility of articles having little differences in mechanical properties between their surfaces and core portions.

The steel alloys of this invention can be not only applicable to construction machine parts but also useful as materials for parts of crushers, dredgers, mining machines, etc., which require both wear and impact resistance.

The invention may be embodied in other specific forms without departing from the spirit or essential characteristics thereof. The present embodiments are therefore to be considered in all respects as illustrative and not restrictive, the scope of the invention being indicated by the appended claim rather than by the foregoing description, and all changes which come within the meaning and range of equivalency of the claim are therefore intended to be embraced therein.

What is claimed is:

1. An improved low temperature steel alloy having a high toughness and hardness consisting essentially of from 0.20 to 0.30 wt % of carbon
from 1.20 to 2.00 wt % of silicon
from 0.30 to 0.80 wt % of manganese
from 1.70 to 2.40 wt % of nickel
from 2.50 to 3.50 wt % of chromium
from 0.30 to 0.55 wt % of molybdenum
and the balance essentially iron.

* * * * *